United States Patent [19]

Podunavac

[11] 4,320,684

[45] Mar. 23, 1982

[54] GUITAR CONSTRUCTION

[76] Inventor: Bozo Podunavac, 2726 University Ave., San Diego, Calif. 92104

[21] Appl. No.: 126,211

[22] Filed: Mar. 3, 1980

[51] Int. Cl.[3] ..... G10D 3/02

[52] U.S. Cl. ..... 84/291; 84/267

[58] Field of Search ..... D17/16–15, D17/18–19; 84/173, 267–268, 291–292

[56] References Cited

U.S. PATENT DOCUMENTS

| | | | |
|---|---|---|---|
| 860,350 | 7/1907 | Clopton | 84/268 |
| 2,270,612 | 1/1942 | Williams | 84/267 |
| 4,161,130 | 7/1979 | Lieber | 84/267 |

*Primary Examiner*—Lawrence R. Franklin

*Attorney, Agent, or Firm*—Leydig, Voit, Osann, Mayer & Holt, Ltd.

[57] ABSTRACT

A guitar having a body formed from a wood top plate and a one piece plastic molded side and bottom section. The sides of the molded body section are formed with a plurality of distinct inwardly and downwardly directed steps that are adopted to enhance sound projection and tone in a manner heretofore possible only with expensive handcrafted guitar bodies.

4 Claims, 7 Drawing Figures

GUITAR CONSTRUCTION

DESCRIPTION OF THE INVENTION

The present invention relates generally to stringed instruments, and more particularly to guitars.

Acoustical guitars commonly are formed with hollow wood body constructions that have essentially straight or vertically disposed sides such that the top and backsides of the guitar are of similar shape and dimension. It is also common practice to include internal bracing within the hollow body in order to provide sufficient strength and durability to the relatively thin walled construction, which can otherwise be quite fragile. The tones produced with such hollow guitar bodies have been largely dependent upon the materials employed and the quality of construction. Since extensive internal bracing will adversely affect sound projection, it heretofore has not been possible to produce a durable guitar body construction capable of producing quality tones and sound projections without great care and expense.

It is an object of the present invention to provide a hollow bodied guitar with improved sound projection and tone quality.

Another object is to provide a guitar as characterized above in which the body is durably constructed without the need for internal bracing and the like.

A further object is to provide a guitar of the above kind in which the body is formed with a one-piece molded back section uniquely shaped to enhance sound projection and tone.

Still another object is to provide a guitar of the foregoing type which is economical to manufacture without sacrifice to tone and sound projection characteristics.

Other objects and advantages of the invention will become apparent as the foregoing description proceeds taken in conjunction with the accompanying drawings in which.

Figure 1:
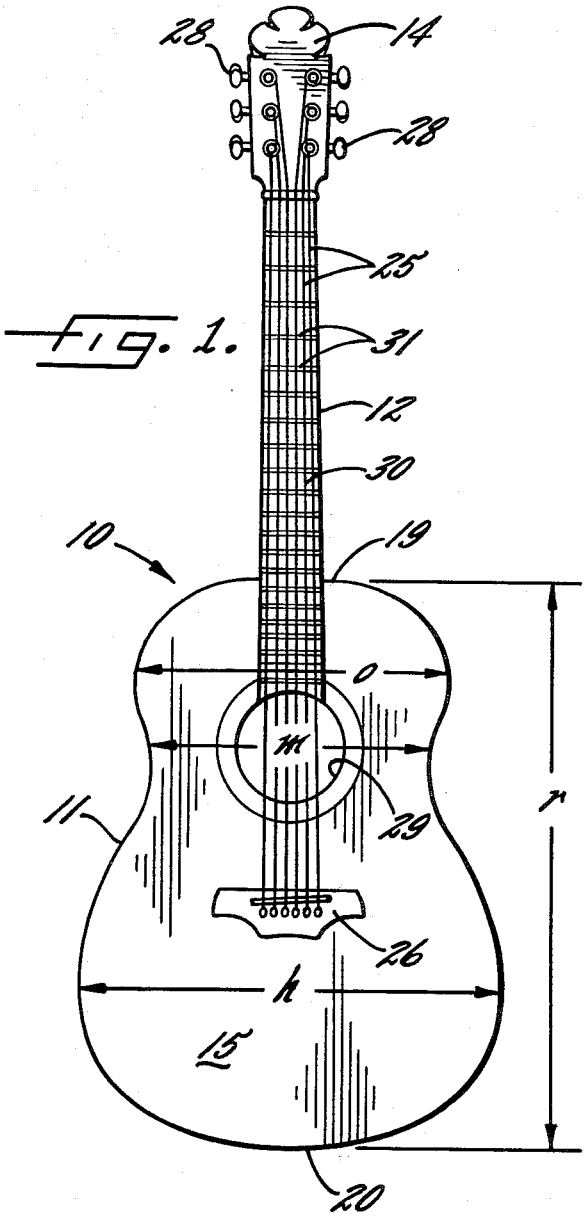
FIG. 1 is a front view of an illustrative guitar embodying the present invention.
Figure 2:
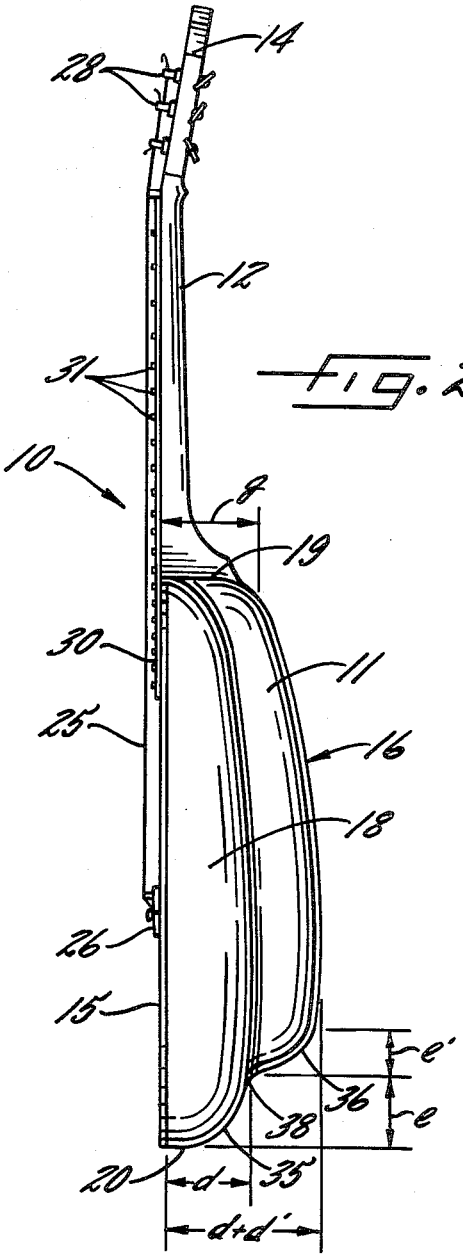
FIG. 2 is a side view of the guitar as shown in FIG. 1.
Figure 3:
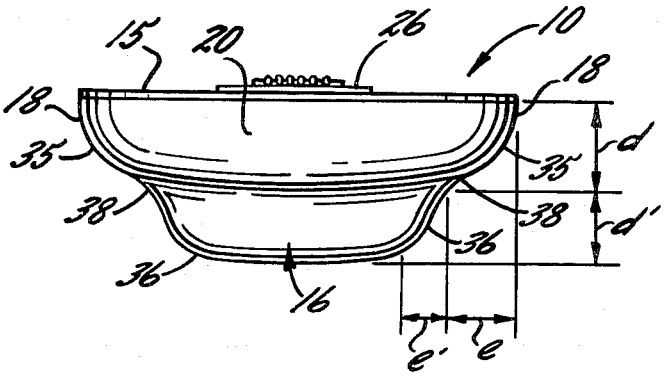
FIG. 3 is an end view of the guitar as shown in FIG. 1.
Figure 4:
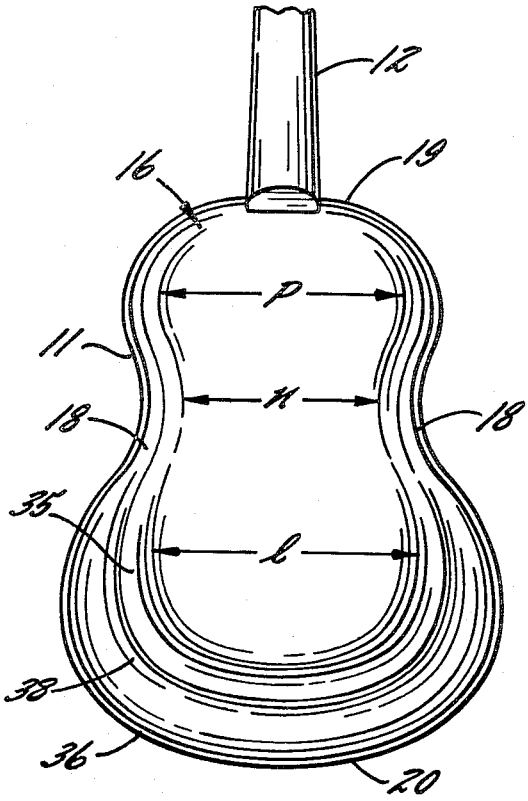
FIG. 4 is a back view of the body of the guitar shown in FIG. 1.
Figure 5:
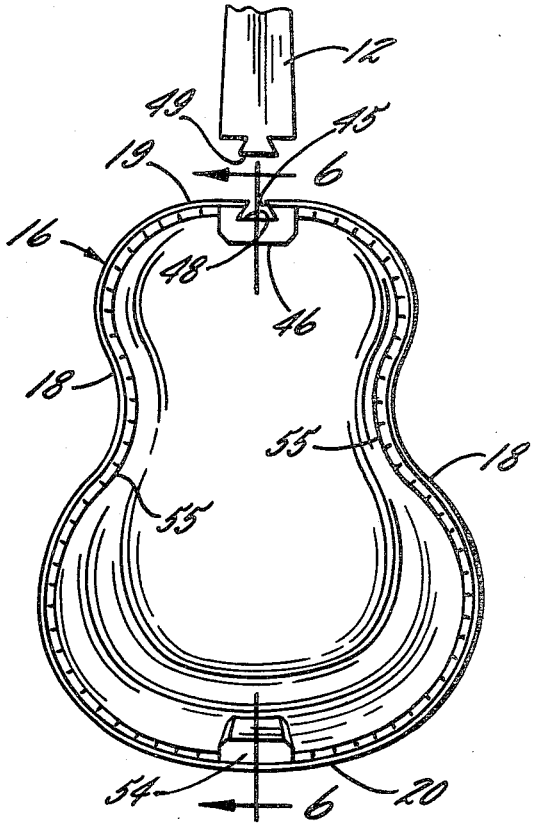
FIG. 5 shows the interior of the body of the guitar with the neck in disassembled condition.
Figure 6:
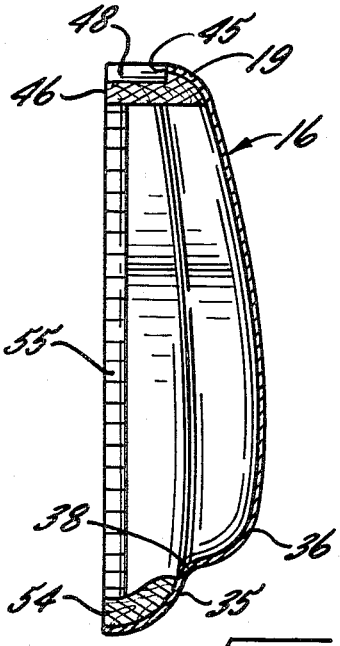
FIG. 6 is a vertical section taken in the plane of line 6—6 in FIG. 5.
Figure 7:
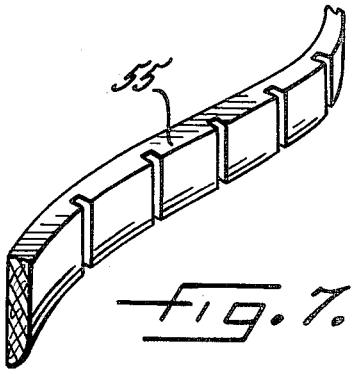
FIG. 7 is a perspective of a lining strip applied to the inside of the body to facilitate attachment of the body top plate.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, our intention is to cover all modifications, alternative constructions and equivalents falling within the spirit and scope of the invention.

Referring more particularly to the drawings, there is shown an illustrative guitar 10 embodying the present invention. The guitar 10 in this case is an acoustical type comprising a hollow body 11, a neck 12 extending upwardly of the body, and a head 14 disposed at the upper end of the neck. The body 11 comprises a substantially flat top plate 15 and a one-piece side and bottom section 16. The body section 16 defines lateral sides 18, a heel end 19, and a tail end 20. The sides and ends of the body section 16 form generally U-shaped upper and lower bouts at the heel and tail ends, respectively, connected by inwardly curved central bouts which form the waist of the instrument.

A plurality of guitar stings 25 are stretched from a bridge 26 located centrally on the top body plate 15 to respective turnkeys 28 rotatably mounted in the head 14. The guitar strings 25 are secured to the bridge in a conventional manner and can be selectively tightened to the desired tension by rotation of the turnkeys 28. The body top plate 15 may be made of wood, such as spruce, and is formed with a circular shaped sound opening 29 disposed directly beneath the springs in the usual manner. The neck 12 carries a fret board 30, preferably made of ebony or rosewood, having a plurality of frets 31.

In accordance with the invention, the side and bottom body section is formed with a stepped molded plastic construction that is adapted to enhance sound projection and tone. In the illustrated embodiment, the tail end 20 and lateral sides 18 of the guitar are formed with two distinct steps 35, 36 such that the bottom of the body is smaller, but generally proportionally similar, to the top plate. The steps 35, 36 in this instance each have a curved configuration that extend downwardly about one-half the depth of the body, and are connected by a reversally curved portion 38 of a smaller radius than the steps. Preferably the upper step 35 extends inwardly a distance "e" about equal to, or slightly less than, the depth "d" of the step, and the second step 36 extends inwardly a distance "e'" of about one-half of its depth "d'". The second step 36 is formed to blend smoothly into the bottom of the body section 16.

The bottom of the body section 16 preferably is slightly arched both laterally, i.e. from side to side, and longitudinally, i.e. from forward into heel end. The body section 16 preferably also is tapered, having a depth "g" at the heel end which is about one inch shallower than the depth of the body at the tail end.

In keeping with the invention, the body section 16 is molded of a hard plastic material, such as an ABS resin (acrylonitrile-butadiene-styrene-resin), and may be cast in a two-part mold in a conventional manner. The plastic may be appropriately colored such as to blend with the wood top plate 15. The interior of the body section 16 is formed with smooth curved surfaces, and the two-step construction of the sides 18 and end 20 provides sufficient strength and rigidity such that further internal bracing of the body is unnecessary. To facilitate connecting the neck 12 to the body 11, the heel end 19 of the molded body section 16 is formed with an opening 45 for receiving the neck and a heel block 46 formed with a dovetail slot 48 is secured to the inside wall of the body section by an appropriate adhesive or glue such that the dovetail slot 48 is located in alignment with the opening 45. The end of the neck is formed with a dovetail extension 49 which is rigidly secured in the slot 48. The top plate 15 is adhesively secured to the body section 16, and in this instance, to facilitate securing the top plate to the body, a tail block 54 is mounted at the tail end of the body and lining strips 55 are glued about the upper periphery of the body section between the heel and tail blocks 46, 54. The tail blocks 20 also permits secure attachment of an appropriate shoulder strap if desired.

In one example of guitar embodying the present invention, the first step 35 in the lower bout was formed with a depth "d" of about $2\frac{1}{2}$ inches and an inward dimension "e" of 2 inches, and the width of this step gradually tapered to zero as it reached the heel end 19 of the body. The second step 36 had a depth d' of about $2\frac{1}{4}$ inches and an inward dimension e' of one inch. With such a stepped body form, the lower bout had a maximum width "h" at the top plate of $15\frac{1}{4}$ inches, which was six inches greater than the lower bout width "l" at the bottom of the body. At the waist, the width "m" at the top plate was $10\frac{1}{4}$ inches and the width "n" at the bottom was $6\frac{1}{2}$ inches. At the upper bout, the maximum width "o" was $11\frac{1}{4}$ inches at the top while at the bottom the width "p" was $8\frac{1}{4}$ inches. The overall length "r" of the body was $19\frac{3}{4}$ inches, and the body had a depth "g" of $3\frac{1}{2}$ inches at the heel end and a depth d+d' of about $4\frac{3}{4}$ inches at the tail end.

The foregoing guitar was found to have high quality tone and sound projection comparable to that of expensive handcrafted wooden guitar bodies. The first step 35 of the body is believed to allow additional vibration, especially in the lower bout area, where the majority of the sound of the guitar is produced. The second step 36 is believed to further contribute to the overall sound projection and tone quality of the instrument. The result was a richer, mellower, and more balanced sounding guitar, with less biting treble sounds. While such sound quality and projection was similar to that of expensive handcrafted crafted guitars, it will be apparent to one skilled in the art, that the molded one-piece plastic body construction of the present invention lends itself to efficient and economical production.

From the foregoing, it can be seen that the stepped molded guitar body of the present invention is susceptible to efficient production without sacrifice to sound projection and tone. The body is also durably constructed without the need for internal bracing and the like, which heretofore has detracted from the tone and sound projection of such stringed instruments. While the invention has been illustrated with reference to a specific guitar body size and shape, it will be understood that the invention is equally applicable to alternative forms. For example, applicant has found that similar sound quality and projection can be derived from larger size guitars in which the dimensions "h", "m", "o", "l", "n" and "p" would be $1\frac{1}{2}$ to 2 inches larger than those described in the foregoing example, while the depth of the body remained the same. Moreover, the stepped molded body construction of the foregoing type can also be used with cutaway bodies in which one side is cut away at the heel end to permit the greater access to the strings.

I claim as my invention:

1. An acoustical guitar comprising a hollow body which includes upper and lower bouts interconnected by inwardly curved central side portions, a neck connected at one end to the upper bout of said body and extending outwardly therefrom, a head disposed at the other end of said neck, a plurality of strings disposed along the length of said neck, a bridge mounted on said body for securing one end of said strings, means on said head for securing the opposite ends of said strings in a tensioned condition, said body including a wooden top plate and a one piece plastic molded side and bottom section, said side and bottom section being formed with a pair of lateral sides, a heel end, and a tail end, said lateral sides and tail end being formed with two distinct inwardly directed steps such that the bottom of said side and bottom section is of smaller size than said top plate, said steps including a first step of outwardly curved configuration extending inwardly and downwardly from said top plate and a second step of outwardly curved configuration connecting said first step to the bottom of said side and bottom section, said curved steps being connected by a reversely curved connecting portion, said steps each having a depth of about one-half the depth of said bottom section, and said first step extending inwardly a distance about equal to the depth of said first step and said second step extending inwardly a distance of about one-half the depth of said second step.

2. The guitar of claim 1 in which said upper bout of said body is at the heel end and said lower bout is at the tail end, and said first step at said lower bout extends downwardly about two inches and inwardly about two inches, and said second step at said lower bout extends downwardly about two inches and inwardly about one inch.

3. The guitar of claim 1 in which said upper bout of said body is at the heel end and said lower bout is at the tail end, said lower bout having a maximum width at the top plate that is about six inches greater than the maximum width at the bottom of said side and bottom section, and said upper bout having a maximum width at said top plate that is about three inches greater than the maximum width at the bottom of said side and bottom section.

4. The guitar of claim 1 in which said body is tapered between said heel and tail ends with the depth of the body at the heel end being about one inch less than the depth of the body at the tail end.

* * * * *